US010460579B1

(12) United States Patent
Russell et al.

(10) Patent No.: US 10,460,579 B1
(45) Date of Patent: Oct. 29, 2019

(54) TAMPER DETECTION SYSTEM

(71) Applicant: The United States of America as represented by the Secretary of the Navy, San Diego, CA (US)

(72) Inventors: Stephen D. Russell, San Diego, CA (US); Joanna N. Ptasinski, San Diego, CA (US); Ayax D. Ramirez, Chula Vista, CA (US)

(73) Assignee: United States of America as represented by Secretary of the Navy, Washington, DC (US)

( * ) Notice: Subject to any disclaimer, the term of this patent is extended or adjusted under 35 U.S.C. 154(b) by 0 days.

(21) Appl. No.: 16/177,986

(22) Filed: Nov. 1, 2018

(51) Int. Cl.
*G08B 13/183* (2006.01)

(52) U.S. Cl.
CPC ..... *G08B 13/183* (2013.01)

(58) Field of Classification Search
CPC ..... G01M 1/00; G01L 1/00
See application file for complete search history.

(56) References Cited

U.S. PATENT DOCUMENTS

| | | | | |
|---|---|---|---|---|
| 9,624,008 | B2 | 4/2017 | Thorstensen-Woll et al. | |
| 9,626,882 | B2 | 4/2017 | Dodrill | |
| 2015/0242057 | A1* | 8/2015 | Galela | G06F 3/0428 345/175 |
| 2016/0040061 | A1* | 2/2016 | Krowne | C08K 3/013 128/844 |
| 2017/0328741 | A1* | 11/2017 | Okoli | G02B 6/03694 |

OTHER PUBLICATIONS

Dong Tu, LiNbO3:Pr3+: A Multipiezo Material with Simultaneous Piezoelectricity and Sensitive Piezoluminescence, Advanced Materials, Apr. 3, 2017 (Year: 2017).*

Ian Sage et al., Triboluminescent Materials for Structural Damage Monitoring, J. Mater. Chem., Aug. 30, 2000, pp. 231-45, vol. 11, The Royal Society of Chemistry.

Seung Wook Shin et al., Origin of Mechanoluminescence from Cu-Doped ZnS Particles Embedded in an Elastomer Film and Its Application in Flexible Electro-mechanoluminescent Lighting Devices, ACS Appl. Mater. Interfaces, 2015, pp. 1098-1103, vol. 8, American Chemical Society.

Dong Tu et al., LiNbO3:Pr(3+): A Multipiezo Material with Simultaneous Piezoelectricity and Sensitive Piezoluminescence, Adv. Mater., Apr. 2017, Wiley-VCH Verlag GmbH & Co. KGaA, Weinheim, Germany.

Jun-Cheng Zhang et al., Novel Elastico-Mechanoluminescence Materials CaZnOS:Mn(2+) and CaZr(PO4)2:Eu(2+), J. Adv. Dielect., May 14, 2014, vol. 4, World Scientific Publishing Company.

Soon Moon Jeong et al., Color Manipulation of Mechanoluminescence from Stress-Activated Composite Films, Adv. Mater., 2013, pp. 6194-6200, vol. 25, Wiley-VCH Verlag GmbH & Co. KGaA, Weinheim, Germany.

* cited by examiner

*Primary Examiner* — Shirley Lu
(74) *Attorney, Agent, or Firm* — Naval Information Warfare Center, Pacific; Kyle Eppele; Young Fei

(57) ABSTRACT

A system for detecting tampering. The system comprises a first luminescent layer adjacent to a first item of value and an optical detector operably connected to an alarm. The first luminescent layer emits a light beam, which is detected by the optical detector. Upon detection of the light beam, the optical detector activates the alarm.

20 Claims, 5 Drawing Sheets

| Compound | Name |
|---|---|
| **1** | *Europium tetrakis(dibenzoylmethide)triethylammonium* |
| **2** | *Europium tris(2-thenoyltrifluoroacetone)phenanthroline* |
| **3** | *Hexakis(antiphrine)terbium triiodide* |
| **4** | *Tris(1,3-di-tert-butyl-β-propanedione)terbium-p-dimethylaminopyridine* |
| **5** | *Tris(1,3-di-tert-butyl-β-propanedione)samarium-p-dimethylaminopyridine* |
| **6** | *Tris(1,3-di-tert-butyl-β-propanedione)dysprosium-p-dimethylaminopyridine* |
| **7** | Terbium trichloride hexahydrate |
| **8** | Mn:ZnS |
| **9** | *Dibromobis(triphenylphosphine oxide)manganese* |
| **10** | Europium(2+)hexacelsian |
| **11** | Samarium(2+ and 3+) hexacelsian |
| **12** | Cerium(3+) hexacelsian |
| **13** | Terbium(3+) hexacelsian |
| **14** | Dysprosium(3+) hexacelsian |
| **15** | *Cholesteryl salicylate* |
| **16** | *N-Acetylanthranilic acid* |
| **17** | *Salicylsalicylic acid* |
| **18** | *Menthyl-9-anthracenecarboxylate* |
| **19** | 9-Isopropylcarbazole |

*FIG. 9*

TAMPER DETECTION SYSTEM

FEDERALLY SPONSORED RESEARCH AND DEVELOPMENT

The Tamper Detection System is assigned to the United States Government and is available for licensing and commercial purposes. Licensing and technical inquiries may be directed to the Office of Research and Technical Applications, Space and Naval Warfare Systems Center Pacific (Code 72120), San Diego, Calif., 92152 via telephone at (616) 553-2778 or email at ssc_pac_t2@navy.mil. Reference Navy Case 106491.

BACKGROUND OF THE INVENTION

1. Field of the Invention

The present invention relates to systems for detecting tampering generally, and a system designed to provide a real-time alert to remote users that tampering is occurring on an item or items of high-importance or high-value specifically.

2. Description of the Related Art

There are numerous devices designed to detect tampering on an item of high-importance or high-value. The simplest can be a piece of tape placed across two surfaces of an enclosure. If the enclosure is opened, the tape is broken, and the broken tape serves as visually apparent physical evidence that the enclosure has been opened. Other technologies include U.S. Pat. No. 9,626,882, where the sealing element uses cohesive peeling to visually indicate where a sealing element has been opened. These technologies however, do not provide real-time alerts to a user of possible tampering.

More sophisticated security devices include magnetic sensors and similar technologies. In these devices, a permanent magnet is affixed to one surface, and a magnetic sensor is affixed to an opposing surface and operatively connected to the permanent magnet. If the sensor and magnet are separated, the magnetic field's effect on the sensor is changed, and an alarm may be triggered. While these devices may be remotely monitored, they only detect displacement between two surfaces, and cannot detect more sophisticated tampering.

Additional techniques employ a light beam on one surface and an optical sensor on a second surface. When the beam of light is broken by displacement of one of the surfaces with respect to the other (or by obscuration), a remote alarm can be triggered. While these devices may be remotely monitored, they cannot detect more sophisticated tampering. These existing devices do not, and cannot detect tampering over a specific area (for example, on a specific electronic circuit or on a specific microchip on a circuit board).

SUMMARY OF THE INVENTION

The present invention is a system for detecting tampering. The system comprises a first luminescent layer adjacent to a first item of value and an optical detector operably connected to an alarm. The first luminescent layer emits a light beam, which is detected by the optical detector. Upon detection of the light beam, the optical detector activates the alarm.

An embodiment of the invention also includes a second item of value adjacent to a circuit board, a third item of value adjacent to the circuit board, and a fourth item of value adjacent to the circuit board. The first item of value is also adjacent to the circuit board. The first luminescent layer encloses the first item of value, the second item of value, the third item of value, and the fourth item of value. A first optical transmission medium is adjacent to the first luminescent layer, and a second optical transmission medium is adjacent to the first optical transmission medium. An optical detector is adjacent to the second optical transmission medium, and an alarm is operably connected to the optical detector. The light beam is transmitted through the first optical transmission medium and the second optical transmission medium.

Another embodiment of the invention includes a second luminescent layer enclosing the first item of value, a third luminescent layer enclosing the second item of value, a fourth luminescent layer enclosing the third item of value, and a fifth luminescent layer enclosing the fourth item of value. The second luminescent layer emits a light beam, which is transmitted through the first optical transmission medium and the second optical transmission medium. The light beam is detected by the optical detector. Upon detection of the light beam, the optical detector activates the alarm.

BRIEF DESCRIPTION OF THE DRAWINGS

Throughout the several views, like elements are referenced using like elements. The elements in the figures are not drawn to scale, and some dimensions may be exaggerated for clarity.

FIG. 9 is a table of triboluminescent materials.

DETAILED DESCRIPTION OF THE INVENTION

While this invention may be embodied in different forms, the drawings and this section describe in detail specific embodiments of the invention with the understanding that the present disclosure is to be considered merely a preferred embodiment of the invention, and is not intended to limit the invention in any way.

The present invention uses the property of triboluminescence, an optical phenomenon in which light is generated through the breaking of chemical bonds in a material when it is pulled apart, ripped, scratched, crushed, or rubbed. Triboluminescence includes the properties of fractoluminescence (where light is emitted by the destructive fracturing of materials) and piezoluminescence (when light is emitted by the non-destructive deformation of materials). More generally, mechanoluminescence is luminescence resulting from any mechanical action on a solid.

Figure 1:
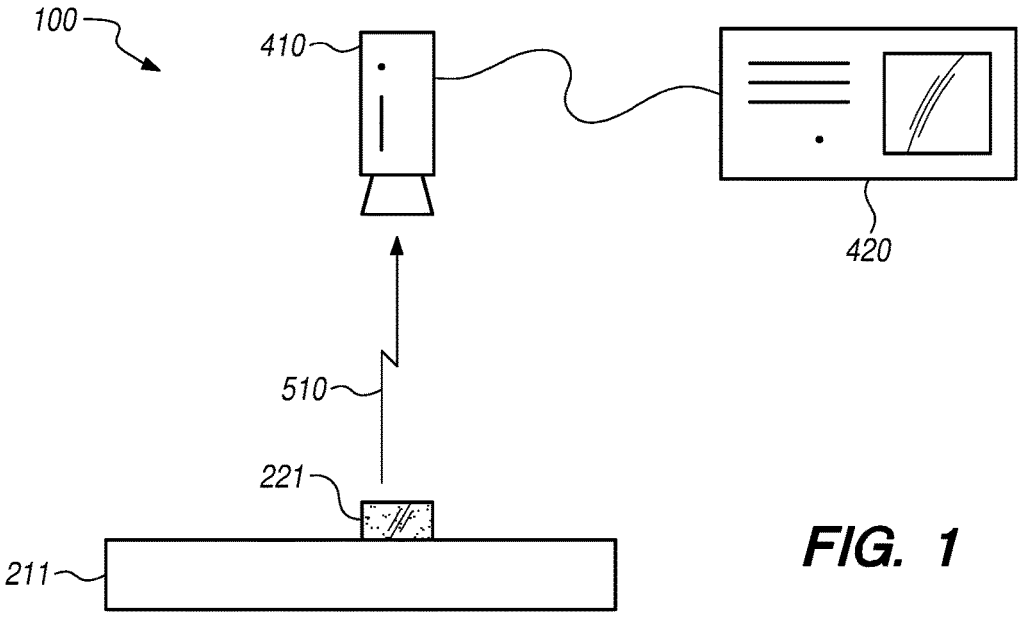
FIG. 1 is a front elevation view of an embodiment of the present invention.
Figure 5:
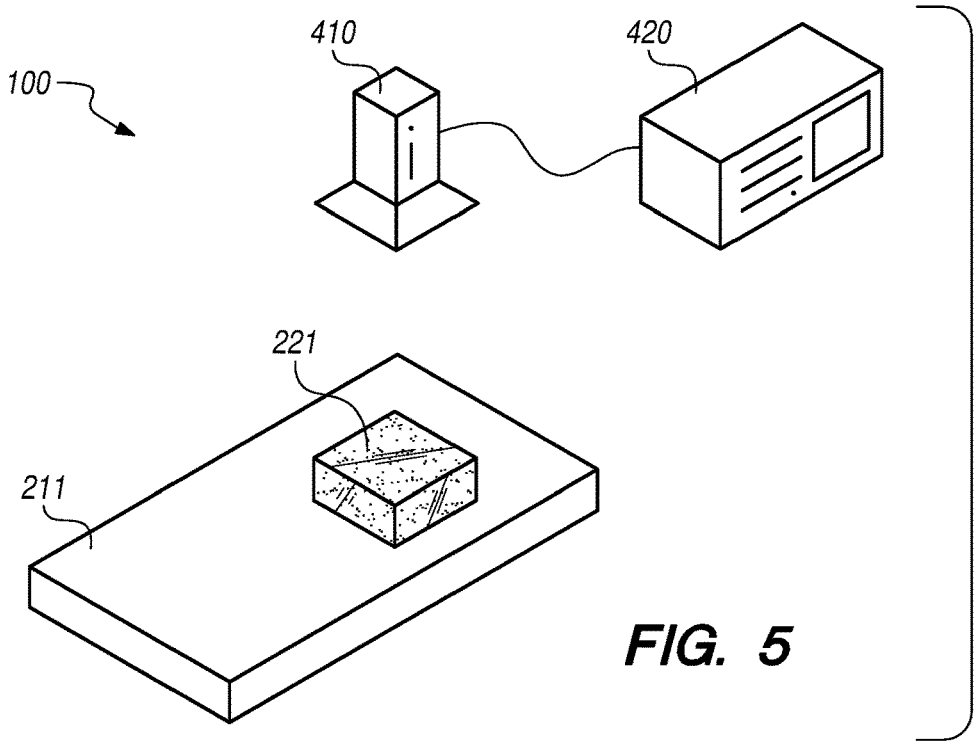
FIG. 5 is a front isometric view of an embodiment of the present invention.

FIG. 1 shows an embodiment of a system for detecting tampering 100. The system 100 comprises a first item of value 211. Value implies that it is desirable the first item of value 211 is not tampered with, and does not necessarily imply financial value. The first item of value 211 is at least partially enclosed by a first luminescent layer 221 on at least a portion of one side. An optical detector 410 is used to detect the light beam 510 emitted when the first luminescent layer 221 is tampered with. Where the first luminescent layer 221 is a triboluminescent, fractoluminescent, piezoluminescent, or mechanoluminescent material, the tampering causes the light emission. The optical detector 410 is operably connected to an alarm 420, which can notify the user of the tampering in real-time. FIG. 5 shows an isometric view of the embodiment depicted in FIG. 1.

Figure 2:
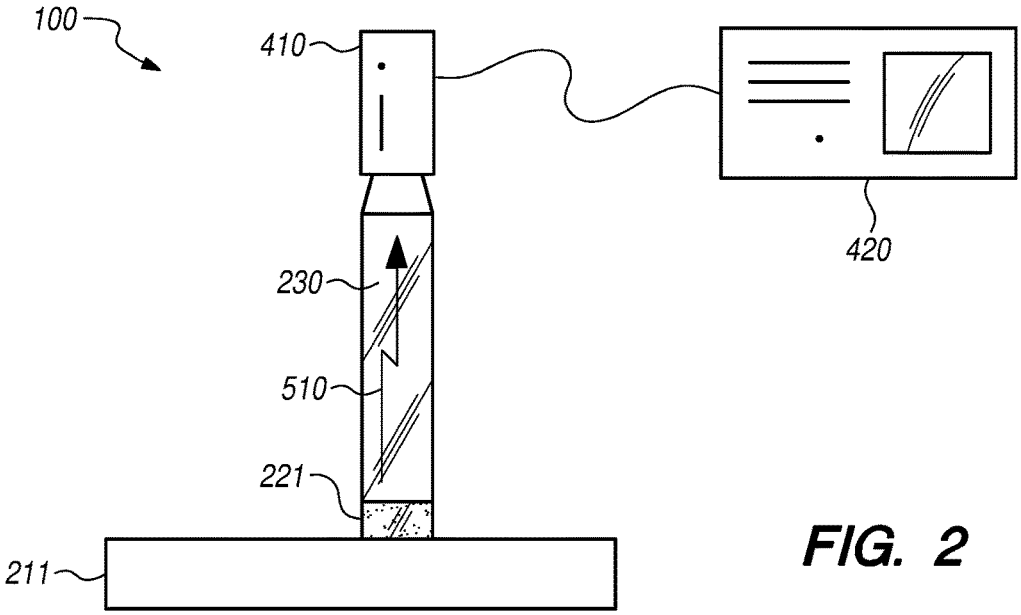
FIG. 2 is a front elevation view of an embodiment of the present invention.
Figure 6:
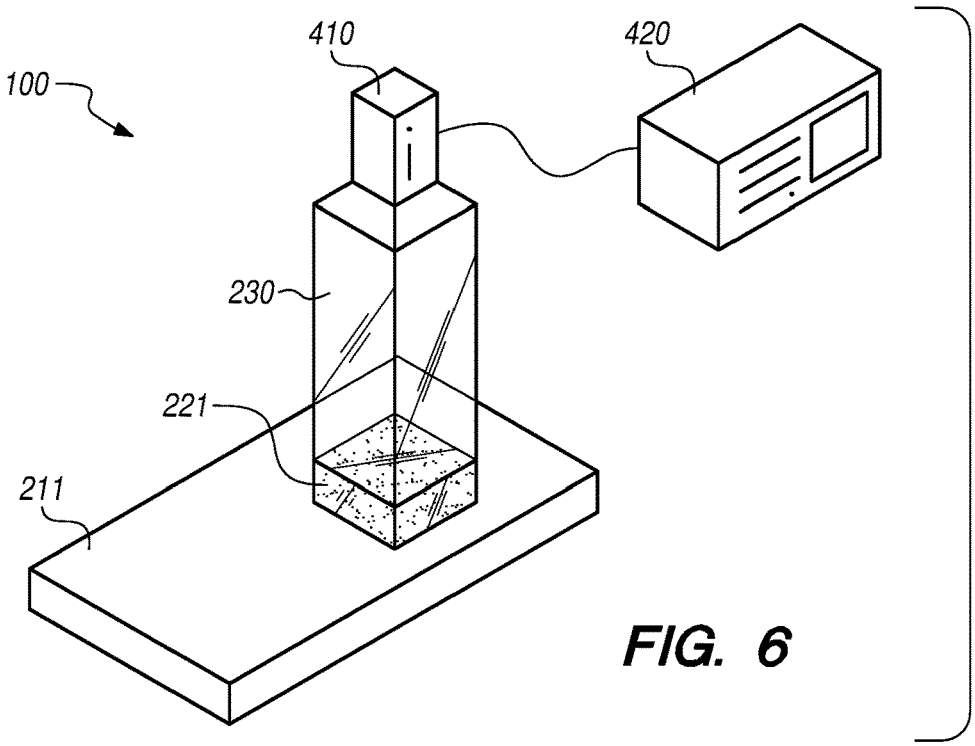
FIG. 6 is a front isometric view of an embodiment of the present invention.

FIG. 2 shows an embodiment of the system 100 including a first optical transmission medium 230. The first optical transmission medium 230 may be an optical fiber, an optical waveguide, optical fabric, or some similar material. The first optical transmission medium 230 is adjacent to the first luminescent layer 221 at one end, and adjacent to the optical detector 410 at the other end. The first optical transmission medium 230 is used to transmit the light beam 510 more efficiently from the first luminescent layer 221 to the optical detector 410. FIG. 6 shows an isometric view of the embodiment depicted in FIG. 2.

Figure 3:
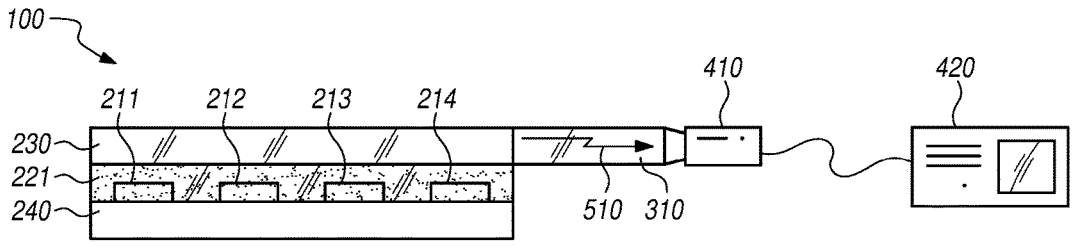
FIG. 3 is a front elevation view of an embodiment of the present invention.
Figure 7:
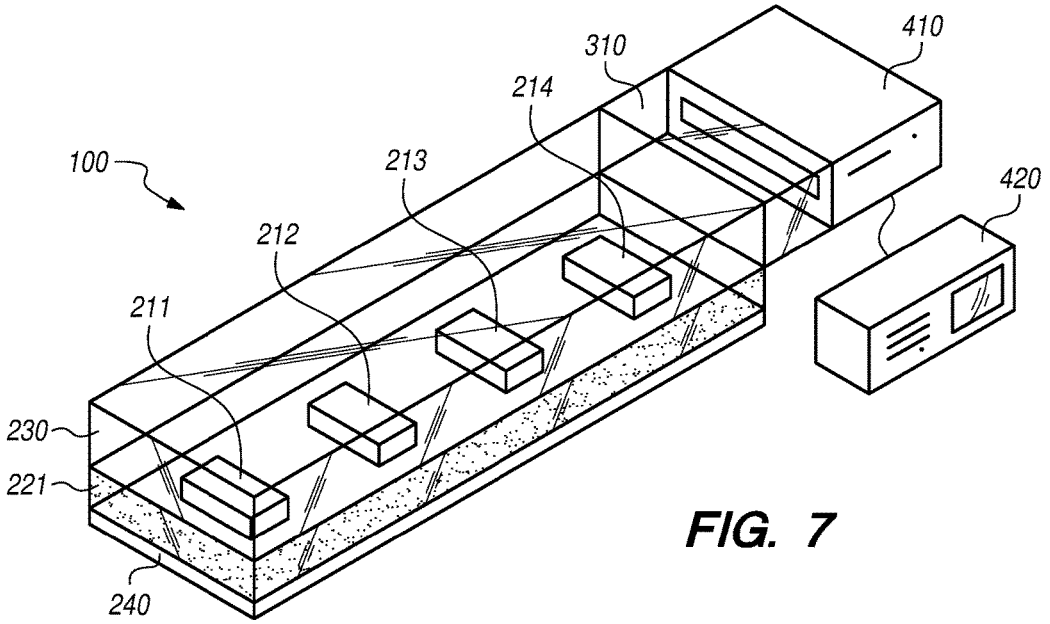
FIG. 7 is a front isometric view of an embodiment of the present invention.

FIG. 3 shows an embodiment of the system 100 with the items of value located on a circuit board 240. In this embodiment, there is a first item of value 211, a second item of value 212, a third item of value 213, and a fourth item of value 214 located on one side of the circuit board 240. The first luminescent layer 221 covers each of the four items of value. A first optical transmission medium 230 is adjacent to the first luminescent layer 221. A second optical transmission medium 310 is adjacent to the first optical transmission medium 230. The second optical transmission medium 310 may be an optical fiber, an optical waveguide, optical fabric, or some similar material. In this embodiment, when the light beam 510 is emitted from any of the four items of value, it is transmitted through the first optical transmission medium 230 and second optical transmission medium 310 to the optical detector 410. FIG. 7 shows an isometric view of the embodiment depicted in FIG. 3.

Figure 4:
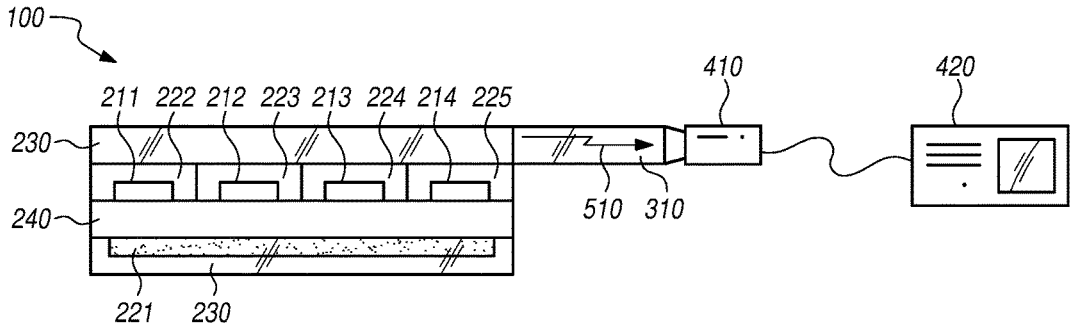
FIG. 4 is a front elevation view of an embodiment of the present invention.
Figure 8:
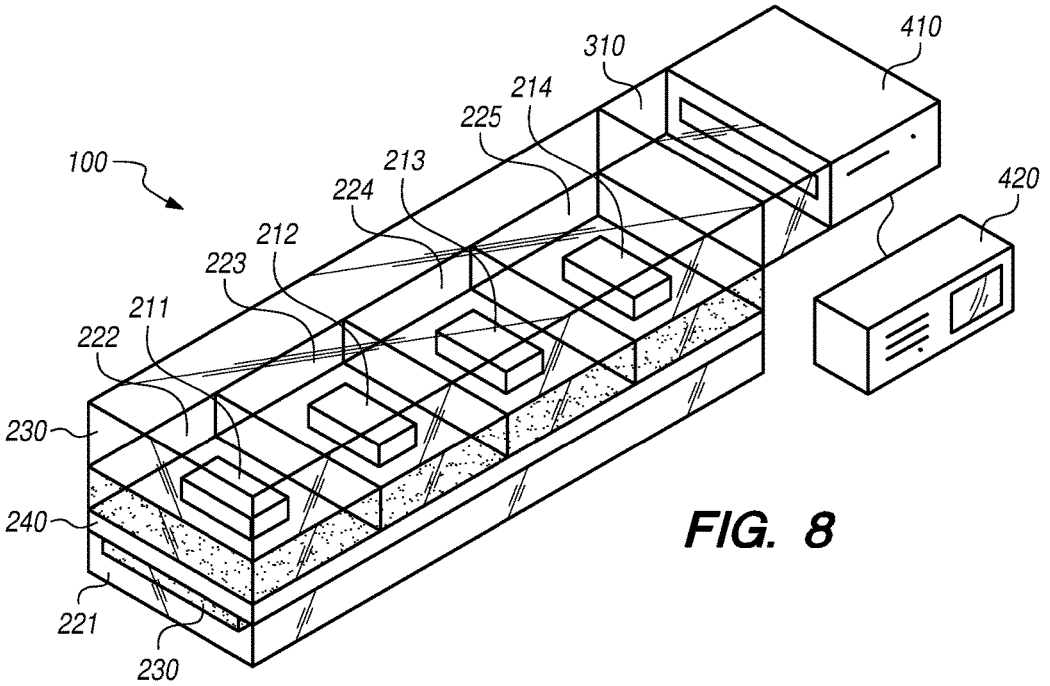
FIG. 8 is a front isometric view of an embodiment of the present invention.

FIG. 4 depicts an embodiment of the system 100 with a first item of value 211, a second item of value 212, a third item of value 213, and a fourth item of value 214 located on one side of a circuit board 240. A second luminescent layer 222 encloses the first item of value 211, a third luminescent layer 223 encloses the second item of value 212, a fourth luminescent layer 224 encloses the third item of value 213, and a fifth luminescent layer 225 encloses a fourth item of value 214. A first luminescent layer 221 is on the other side of the circuit board 240. A first optical transmission medium 230 covers the first luminescent layer 221, and an additional first optical transmission medium 230 covers the second luminescent layer 222, the third luminescent layer 223, the fourth luminescent layer 224, and the fifth luminescent layer 225. A second optical transmission medium 310 is adjacent to the first optical transmission medium 310 at one end, and is adjacent to the optical detector 410 at the second end. When a luminescent layer emits a light beam 510, the light beam 510 travels through the first optical transmission medium 230 and second optical transmission layer 310 to the optical detector 410. Each of the first luminescent layer 221, second luminescent layer 222, third luminescent layer 223, fourth luminescent layer 224, or fifth luminescent layer 225 may be a different luminescent material. Each luminescent layer may be a different material emitting a different wavelength of light. In such an embodiment, then the wavelength of the light beam 510 will correspond with a specific luminescent material and a specific item of value on the circuit board 240, allowing the alarm 420 to identify the region of the circuit board 240 tampered with. FIG. 8 shows an isometric view of the embodiment depicted in FIG. 4.

FIG. 9 is a table of triboluminescent materials that may be used in the present invention. The first compound from FIG. 9, europium tetrakis(dibenzoylmethide)triethylammonium exhibits very strong triboluminescence. Alternatively, piezoluminescent materials may also be used. A high degree of piezoluminescence can be achieved by doping rare earth $Pr^{3+}$ into the piezoelectric matrix $LiNbO_3$. By tuning the Li to Nb ration in non-stoichiometric $Li_xNbO_3:Pr^{3+}$, a material exhibiting unusually high piezoluminescent intensity is produced. Additionally, controlling the concentration of two independent mechanoluminescent materials (such as ZnS:Cu, Mn and ZnSCu). The degree of applied stress will correspond with the color of the tampered device's mechanoluminescent area.

An advantage and new feature of this invention is that it provides a real-time alert to remote uses that tampering is occurring on an item of high-importance or high-value. The alarm system may provide an audible, visual, or digital signal to alert the user to tampering.

Mechanoluminescent materials which may be used with the present invention include x or γ-irradiated alkali halide crystals, ZnS:Mn, $SrAl_2O_4$:Eu, $SrAl_2O_4$:Ce, $SrAl_2O_4$:Ce, Ho, $SrMgAl_6O_{11}$:Eu, $SrCaMgSi_2O_7$:Eu, $SrBaMgSi_2O_7$:Eu, $Sr_2MgSi_2O_7$:Eu, $Ca_2MgSi_2O_7$:Eu,Dy, $CaYAl_3O_7$:Eu, (Ba, Ca)$TiO_3:Pr^{3+}$, $ZnGa_2O_4$:Mn, $MgGa_2O_4$:Mn, $BaAl_2Si_2O_8$: rare earth element, $Ca_2Al_2SiO_7$:Ce, $ZrO_2$:Ti, ZnS:Mn, Te, and the like. The rare earth element can be Eu. Mechanoluminescence has also been observed in nanoparticles of ZnS:mn, $SrAl_2O_4$:Eu, and ZnMnTe. A few polymers and rubbers have also been reported to be elastico-mechanoluminescent. Certain materials such as $SrAl_2O_4$:Eu, $SrMgAl_6O_{11}$:Eu, $Ca_2Al_2SiO_7$:Ce, and $ZrO_2$:Ti show such an intense elastico-mechanoluminescence that it can be seen in daylight with the naked eye. Brighter mechanoluminescence can also be achieved by Cu-doped ZnS and Mn doped ZnS particles embedded in elastomer films.

Additionally, using a material such as $CaZnOS:Mn^2$ allows for the sensing of various types of mechanical stress (including ultrasonic vibration, impact, friction, and compression) because of the large piezoelectric coefficient. The luminescent layers may be formed by evaporative deposition, sputter deposition, pressure adhesion, subsequent thermal processing, and other processing methods.

From the above description of the present invention, it is manifest that various techniques may be used for implementing its concepts without departing from the scope of the claims. The described embodiments are to be considered in all respects as illustrative and not restrictive. The method disclosed herein may be practiced in the absence of any element that is not specifically claimed and/or disclosed herein. It should also be understood that the present invention is not limited to the particular embodiments described herein, but is capable of being practiced in many embodiments without departure from the scope of the claims.

What is claimed is:

1. A system for detecting tampering, comprising:

an item of value;

a luminescent layer enclosing the item of value, wherein the luminescent layer emits a light beam during the tampering to access the item of value;

an optical detector for detecting the light beam emitted during the tampering; and an alarm activated in response to the optical detector detecting the light beam emitted during the tampering, the alarm providing a real-time alert of the tampering to a remote user.

2. The system of claim 1, further comprising an optical transmission medium, wherein a first end of the optical transmission medium is adjacent to the luminescent layer, wherein a second end of the optical transmission medium is adjacent to the optical detector.

3. The system of claim 2, wherein the light beam is transmitted through the optical transmission medium.

4. The system of claim 1, wherein the luminescent layer is a triboluminescent material.

5. The system of claim 1, wherein the luminescent layer is a piezoluminescent material.

6. The system of claim 1, wherein the luminescent layer is a mechanoluminescent material.

7. The system of claim 1, wherein the luminescent layer is europium tetrakis(dibenzoylmethide)triethylammonium.

8. The system of claim 1, wherein the luminescent layer is $Li_xNbO_3:Pr^{3+}$.

9. The system of claim 1, wherein the luminescent layer is ZnS:Cu.

10. The system for detecting tampering of claim 1, wherein the item of value is a first item of value, the system further comprising:

the first item of value adjacent to a circuit board, a second item of value adjacent to the circuit board, a third item of value adjacent to the circuit board, a fourth item of value adjacent to the circuit board;

the luminescent layer enclosing the first item of value, the second item of value, the third item of value, and the fourth item of value;

a first optical transmission medium adjacent to the luminescent layer, a second optical transmission medium adjacent to the first optical transmission medium;

the optical detector adjacent to the second optical transmission medium, the alarm operably connected to the optical detector; and wherein the luminescent layer emits the light beam; wherein the light beam is transmitted through the first optical transmission medium; wherein the light beam is transmitted through the second optical transmission medium; wherein the light beam is detected by the optical detector; wherein upon detection of the light beam, the optical detector activates the alarm.

11. The system of claim 10, wherein the luminescent layer is a triboluminescent material.

12. The system of claim 10, wherein the luminescent layer is a piezoluminescent material.

13. The system of claim 10, wherein the luminescent layer is a mechanoluminescent material.

14. The system of claim 10, wherein the luminescent layer is europium tetrakis(dibenzoylmethide)triethylammonium.

15. The system of claim 10, wherein the luminescent layer is $Li_xNbO_3:Pr^{3+}$.

16. The system of claim 10, wherein the luminescent layer is ZnS:Cu.

17. The system for detecting tampering of claim 1, wherein the item of value is one of a first, second, third, and fourth item of value and the luminescent layer is a corresponding one of a first, second, third, and fourth luminescent layer, the system further comprising:

the first item of value adjacent to a circuit board, the second item of value adjacent to the circuit board, the third item of value adjacent to the circuit board, the fourth item of value adjacent to the circuit board;

the first luminescent layer enclosing the first item of value, the second luminescent layer enclosing the second item of value, the third luminescent layer enclosing the third item of value, the fourth luminescent layer enclosing the fourth item of value;

a first optical transmission medium adjacent to the first luminescent layer, the second luminescent layer, the third luminescent layer, and the fourth luminescent layer;

a second optical transmission medium adjacent to the first optical transmission medium;

the optical detector adjacent to the second optical transmission medium, the alarm operably connected to the optical detector; and wherein the first, second, third, or fourth luminescent layer emits the light beam; wherein the light beam is transmitted through the first optical transmission medium; wherein the light beam is transmitted through the second optical transmission medium; wherein the light beam is detected by the optical detector; wherein upon detection of the light beam, the optical detector activates the alarm.

18. The system of claim 17, wherein the second luminescent layer is europium tetrakis(dibenzoylmethide)triethylammonium.

19. The system of claim 17, wherein the second luminescent layer is $Li_xNbO_3:Pr^{3+}$.

20. The system of claim 17, wherein the second luminescent layer is ZnS:Cu.

* * * * *